US011817032B1

(12) United States Patent
Chen et al.

(10) Patent No.: US 11,817,032 B1
(45) Date of Patent: Nov. 14, 2023

(54) DISPLAY DEVICE AND DISPLAY METHOD

(71) Applicant: TCL CHINA STAR OPTOELECTRONICS TECHNOLOGY CO., LTD., Guangdong (CN)

(72) Inventors: Weifeng Chen, Guangdong (CN); Qingsheng Lan, Guangdong (CN)

(73) Assignee: TCL China Star Optoelectronics Technology Co., Ltd., Guangdong (CN)

( * ) Notice: Subject to any disclaimer, the term of this patent is extended or adjusted under 35 U.S.C. 154(b) by 0 days.

(21) Appl. No.: 18/193,883

(22) Filed: Mar. 31, 2023

(30) Foreign Application Priority Data

Dec. 8, 2022 (CN) ..... 202211581566.9

(51) Int. Cl.
*G09G 3/20* (2006.01)

(52) U.S. Cl.
CPC ... *G09G 3/2074* (2013.01); *G09G 2300/0814* (2013.01); *G09G 2310/027* (2013.01); *G09G 2310/0291* (2013.01); *G09G 2310/08* (2013.01)

(58) Field of Classification Search
CPC ..... G09G 3/2074; G09G 2300/0814; G09G 2310/027; G09G 2310/0291; G09G 2310/08
See application file for complete search history.

(56) References Cited

U.S. PATENT DOCUMENTS

| | | | | |
|---|---|---|---|---|
| 11,403,989 | B2 * | 8/2022 | Pyun | G09G 3/2092 |
| 2017/0345383 | A1 * | 11/2017 | Yin | G09G 3/3648 |
| 2020/0066219 | A1 * | 2/2020 | Hsu | G09G 3/3607 |
| 2021/0407364 | A1 * | 12/2021 | Seo | G09G 3/3233 |
| 2022/0148519 | A1 * | 5/2022 | Hwang | G09G 3/3233 |

* cited by examiner

*Primary Examiner* — Andrew Sasinowski
(74) *Attorney, Agent, or Firm* — PV IP PC; Wei Te Chung; Zhigang Ma

(57) ABSTRACT

The present invention discloses a display device and a display method. A voltage adjustment circuit is configured to compare whether a difference between absolute values of a first data voltage signal and a second data voltage signal at a preset moment exceeds a set threshold range and output a control signal to a voltage adjustment circuit when the difference exceeds the set threshold range. Thus, a first data latch and update signal of a first source driver chip is adjusted by the voltage adjustment circuit, or a second data latch and update signal of a second source driver chip is adjusted, so that the first data voltage signal and the second data voltage signal are respectively output to a first data line and a second data line at a same time.

16 Claims, 7 Drawing Sheets

DISPLAY DEVICE AND DISPLAY METHOD

FIELD OF INVENTION

The present application relates to a field of display technology, in particular, to a display device and a display method.

DESCRIPTION OF PRIOR ART

At present, pixel architectures of display panels mainly include 1 gate 1 data (1G1D) architecture, data line share (DLS) architecture, and triple gate (Tri-gate) architecture. For the DLS architecture and the Tri-gate architecture, a number of source driver chips is reduced by half or more compared to the 1G1D architecture. Therefore, load driven by source driver chip of the DLS architecture or the Tri-gate architecture will be larger than that of the 1G1D, especially the load of the Tri-gate architecture is the largest. When the display panel is displayed, a plurality of source driver chips are usually set. However, when the plurality of source driver chips control a same display panel to realize display, due to influences of signal transmission, processing technology, and load size, charging times corresponding to pixels electrically connected with different source driver chips in the display panel will be different, which will cause obvious problem of split screens in the display panel.

SUMMARY

Embodiments of the present invention provide a display device and a display method, which can improve a problem of split screen of a display panel.

The present application provides a display device, including: a display panel, comprising a plurality of sub-pixels and a plurality of data lines that comprise a first data line and a second data line electrically connected to the plurality of sub-pixels in two adjacent columns respectively; a first source driver chip, configured to output a first data voltage signal to the first data line at a first moment; a second source driver chip, configured to output a second data voltage signal to the second data line at a second moment; a voltage comparison circuit, configured to output a control signal in response to a difference between the absolute values of the first data voltage signal and the second data voltage signal over a threshold range at a preset moment, upon the plurality of sub-pixels in the two adjacent columns displaying a same gray scale; and a voltage adjustment circuit, configured to adjust a first data latch and update signal of the first source driver chip based on the control signal, or adjust a second data latch and update signal of the second source driver chip, so that the first data voltage signal and the second data voltage signal are respectively output to the first data line and the second data line at a same time.

The present invention further provides a display method, which is used in any of the above display devices, including: step S100: when the plurality of sub-pixels in the two adjacent columns are configured to display a same gray scale based on the first data voltage signal and the second data voltage signal, judging whether the difference between the absolute values of the first data voltage signal and the second data voltage signal at the preset moment exceeds the set threshold range by the voltage comparison circuit; step S200: outputting the control signal when the difference between the absolute values exceeds the set threshold range by the voltage comparison circuit; step S300: adjusting the first data latch and update signal of the first source driver chip based on the control signal, or adjusting the second data latch and update signal of the second source driver chip by the voltage adjustment circuit, to make the first data voltage signal and the second data voltage signal are respectively output to the first data line and the second data line at a same time.

The present invention provides a display device and a display method, which compares whether the difference between the absolute values of the first data voltage signal and the second data voltage signal at the preset moment exceeds the set threshold range by using a voltage comparison circuit to output the control signal to the voltage adjustment circuit when the difference exceeds the set threshold range. Thus, the first data latch and update signal of the first source driver chip is adjusted by the voltage adjustment circuit, or the second data latch and update signal of the second source driver chip is adjusted, so that the first data voltage signal and the second data voltage signal are respectively output to the first data line and the second data line at the same time, so as to improve the problem of split screen.

BRIEF DESCRIPTION OF DRAWINGS

In order to explain the technical solutions in the embodiments of the present application more clearly, the following will briefly introduce the drawings needed in the description of the embodiments. Obviously, the drawings in the following description are only some embodiments of the present application. For those skilled in the art, other drawings can be obtained based on these drawings without creative work.

DETAILED DESCRIPTION OF EMBODIMENTS

Figure 1:
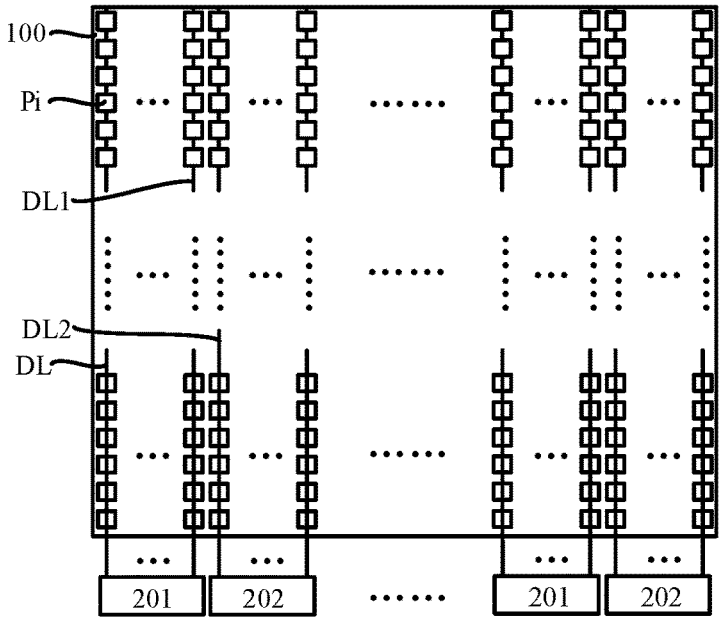
FIG. 1 is a schematic structural diagram of a display device provided by embodiments of the present invention.

In the following, the technical scheme in the embodiment of the present application will be described clearly and completely in combination with the drawings. Obviously, the described embodiments are only a part of the embodiments of the present application, rather than all the embodiments. Based on the embodiments of the present application, all other embodiments obtained by those skilled in the art without creative work fall within the protection scope of the present application. In addition, it should be understood that the specific embodiments described here are only used to illustrate and explain the present invention, and are not intended to limit the present invention. In the present invention, unless stated to the contrary, the used orientation words such as "up" and "down" usually refer to up and down in the actual use or working state of the device, specifically the direction of the drawing in the drawings; while "inside" and "outside" refer to the outline of the device.

Specifically, FIG. 1 is a schematic structural diagram of a display device provided by embodiments of the present invention. The present invention provides a display device, including a display panel 100 and a driving control unit.

Optionally, the display panel 100 includes a liquid crystal display panel, an organic light-emitting diode display panel, a sub-millimeter light-emitting diode display panel, a micro light-emitting diode, a quantum dot display panel, and the like.

The display panel 100 includes a plurality of data lines DL and a plurality of sub-pixels Pi.

The plurality of data lines DL transmit a plurality of data signals. The plurality of data lines DL include a first data line DL1 and a second data line DL2. The first data line DL1 and the second data line DL2 are respectively electrically connected to a plurality of sub-pixels Pi in two adjacent columns.

Optionally, the driving control unit includes a plurality of source driver chips. The plurality of source driver chips are electrically connected to the plurality of data lines DL, so as to output a plurality of data voltage signals to the plurality of data lines DL.

Figure 2:
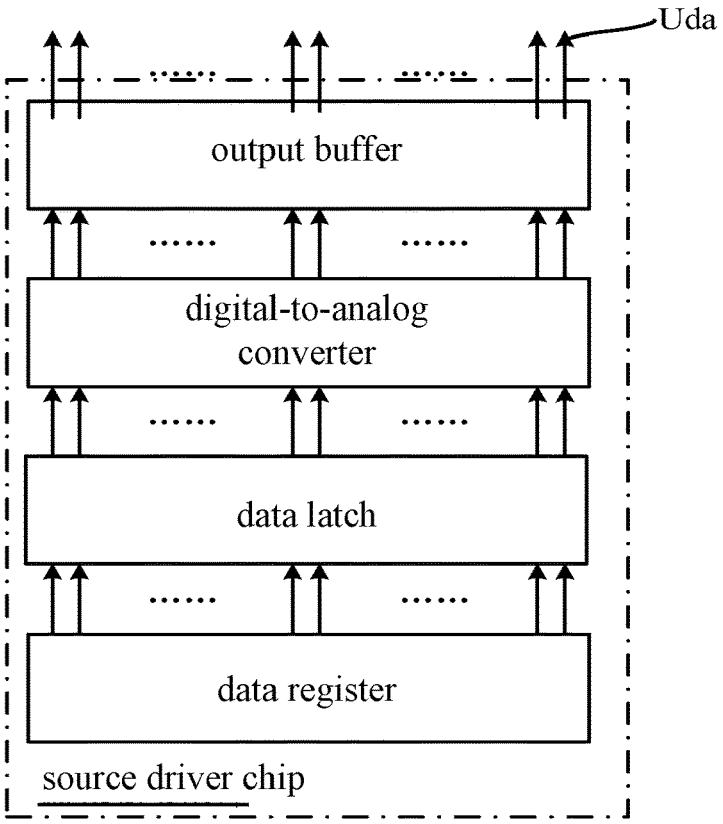
FIG. 2 is a schematic structural diagram of a source driver chip provided by the embodiments of the present invention.

FIG. 2 is a schematic structural diagram of a source driver chip provided by the embodiments of the present invention. Uda represents a data voltage signal. Optionally, each source driver chip includes: a data register, a data latch, a digital-to-analog converter, and an output buffer. The data register is configured to register a plurality of display data. The data latch is configured to latch the plurality of display data. The digital-to-analog converter is configured to convert the plurality of display data latched in the data latch into a plurality of data voltage signals. The output buffer is configured to output the plurality of data voltage signals to the corresponding plurality of data lines DL.

The data register latches the plurality of display data based on corresponding data latch and update signals. The output buffer outputs the plurality of data voltage signals to the corresponding plurality of data lines DL based on the corresponding data latch and update signals.

For convenience of description, it will be described by taking a corresponding electrical connection between two adjacent columns of the sub-pixels Pi and two source driver chips as an example. The plurality of source driver chips include a first source driver chip 201 and a second source driver chip 202. The first source driver chip 201 is configured to output a first data voltage signal to the first data line DL1 at a first moment t1. The second source driver chip 202 is configured to output a second data voltage signal to the second data line DL2 at a second time t2.

Optionally, the first source driver chip 201 includes a first output buffer unit 201*a* configured to output the first data voltage signal to the first data line DL1 at the first time t1. The second source driver chip 202 includes a second output buffer unit 202*a* configured to output the second data voltage signal to the second data line DL2 at the second time t2.

Optionally, the first source driver chip 201 includes a first data register, a first data latch, a first digital-to-analog converter, and a first output buffer. The first data register is configured to register a plurality of display data. The first data latch is configured to latch the plurality of display data at a third time t3. The first digital-to-analog converter is configured to convert the plurality of display data latched in the first data latch into a plurality of data voltage signals. The first output buffer includes a plurality of output buffer units that include a first output buffer unit 201*a*. The plurality of output buffer units of the first output buffer are configured to output the plurality of data voltage signals to the corresponding plurality of data lines DL at the first time t1.

Optionally, the second source driver chip 202 includes a second data register, a second data latch, a second digital-to-analog converter, and a second output buffer. The second data register is configured to register a plurality of display data. The second data latch is configured to latch the plurality of display data at a fourth time t4. The second digital-to-analog converter is configured to convert the plurality of display data latched in the second data latch into a plurality of data voltage signals. The second output buffer includes a plurality of output buffer units that include a second output buffer unit 202*a*. The plurality of output buffer units of the second output buffer are configured to output the plurality of data voltage signals to the corresponding plurality of data lines DL at the first time t1.

Figure 3:
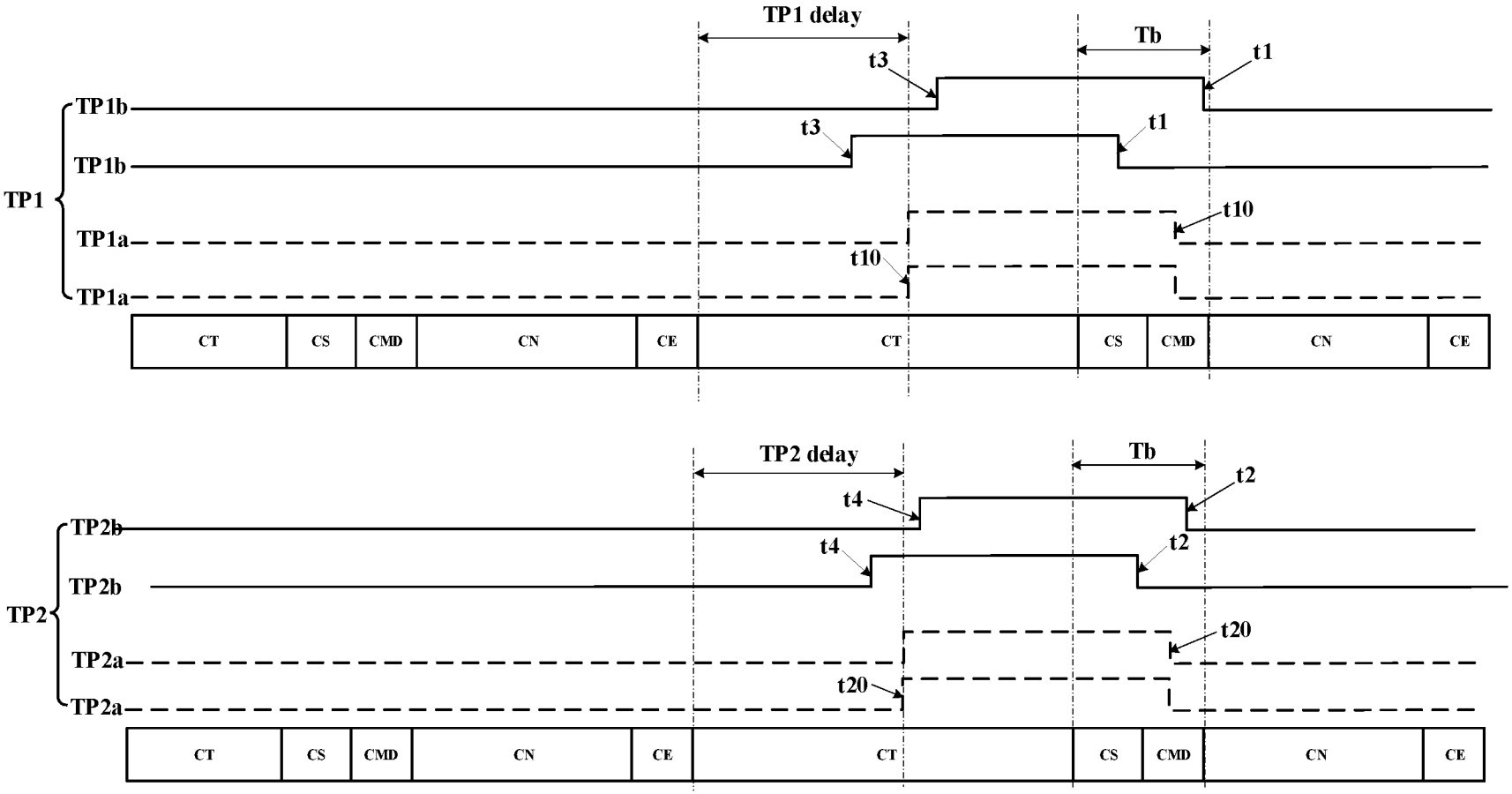
FIG. 3 is a timing diagram of a first data latch and update signal and a second data latch and update signal provided by the embodiments of the present invention.

Optionally, FIG. 3 is a timing diagram of a first data latch and update signal and a second data latch and update signal provided by the embodiments of the present invention. Among them, TP1*a* is a first data latch and update signal before adjustment, TP1*b* is a first data latch and update signal after adjustment. TP2*a* is a second data latch and update signal before adjustment, and TP2*b* is a second data latch and update signal after adjustment. CT represents a horizontal blanking interval. CS represents a data transmission start signal. CE represents a data transmission end signal. CN represents a stage when the data line receives the data voltage signal. A duration corresponding to CMD is determined by a setting parameters of the register. TP1 delay is a stage between an end of the corresponding data transmission end signal CE in the first data latch and update signal TP1 and a rising edge moment. TP2 delay is a stage between an end of the corresponding data transmission end signal CE in the second data latch and update signal TP2 and a rising edge moment. A moment of transition from a second level to a first level in TP1*a* may be the same as or different from a moment of transition from a fourth level to a third level in TP2*a*. Correspondingly, a moment of transition from the first level to the second level in TP1*a* may be the same as or different from a moment of transition from the third level to the fourth level in TP2*a*. A moment of transition from the second level to the first level in TP1*b* may be the same as or different from a moment of transition from the fourth level to the third level in TP2*b*. Correspondingly, a moment of transition from the first level to the second level in TP1*b* may be the same as or different from a moment of transition from the third level to the fourth level in TP2*b*.

Optionally, the first moment t1 is the moment when the first data latch and update signal TP1 transitions from the second level to the first level. The second moment t2 is the moment when the second data latch and update signal TP2 transitions from the fourth level to the first level. The third moment t3 is the moment when the first data latch and update signal TP1 transitions from the first level to the second level. The fourth moment t4 is the moment when the second data latch and update signal TP2 transitions from the third level to the fourth level.

Optionally, the second level corresponds to a high level, the first level corresponds to a low level. The fourth level corresponds to a high level, and the third level corresponds to a low level. Correspondingly, the first moment t1 corresponds to a falling edge moment of the first data latch and update signal TP1. The second moment t2 corresponds to a falling edge moment of the second data latch and update signal TP2. The third moment t3 corresponds to a rising edge moment of the first data latching and updating signal TP1. And the fourth moment t4 corresponds to a rising edge moment of the second data latching and updating signal TP2.

Optionally, the first data latch and update signal TP1 is a signal generated inside the first source driver chip 20. The second data latch and update signal TP2 is a signal generated inside the second source driver chip 202.

It can be understood that each source driver chip is electrically connected to the plurality of data lines through a plurality of output channels, so that a plurality of columns of the sub-pixels are electrically connected to the same source driver chip. However, each source driver chip has a limited number of output channels. When driving a display panel to realize display, the plurality of source driver chips need to work together to realize display control on the display panel. Therefore, affected by signal transmission, process technology, and load size, the data voltage signal transmitted to the display panel 100 will have different degrees of loss (for example, the data voltage signals output by different source driver chips will be output to the display panel through X Board, etc., and different degrees of loss will occur during the transmission of the data voltage signals). As a result, charging times corresponding to the sub-pixels Pi electrically connected to different source driver chips in the display panel 100 will be different. In particular, when two adjacent columns of sub-pixels Pi are electrically connected to different source driver chips, and the plurality of sub-pixels in the two adjacent columns are configured to display a same gray scale based on the first data voltage signal and the second data voltage signal, if there is a large difference between the first data voltage signal and the second data voltage signal, there will be an obvious problem of split screen between the two adjacent columns of sub-pixels Pi. In order to improve the problem of split screen, the driving control unit further includes a voltage comparison circuit 300 and a voltage adjustment circuit 400.

Figure 4A:
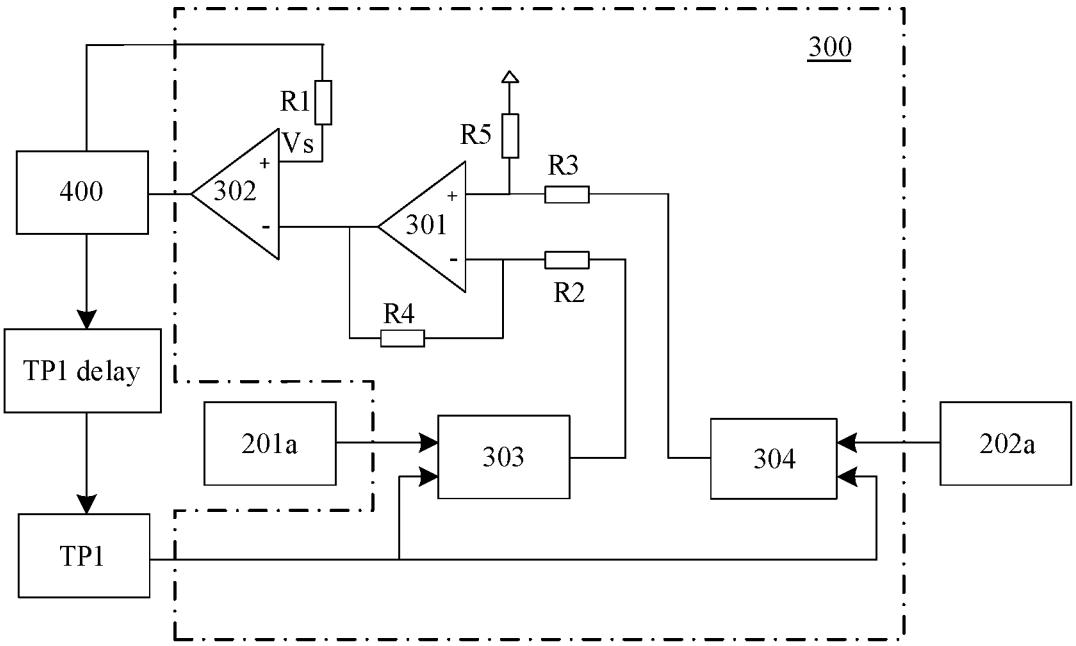
FIG. 4A to FIG. 4C are schematic structural diagrams of a voltage adjustment circuit provided by the present invention.
Figure 4B:
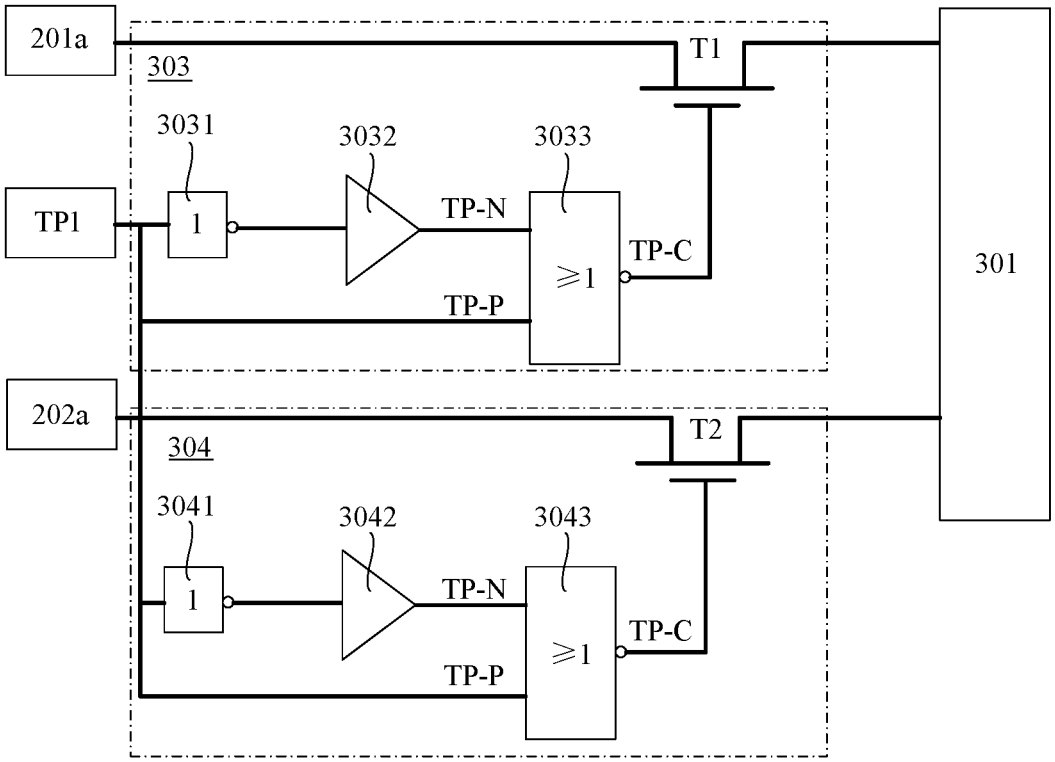
Figure 4C:
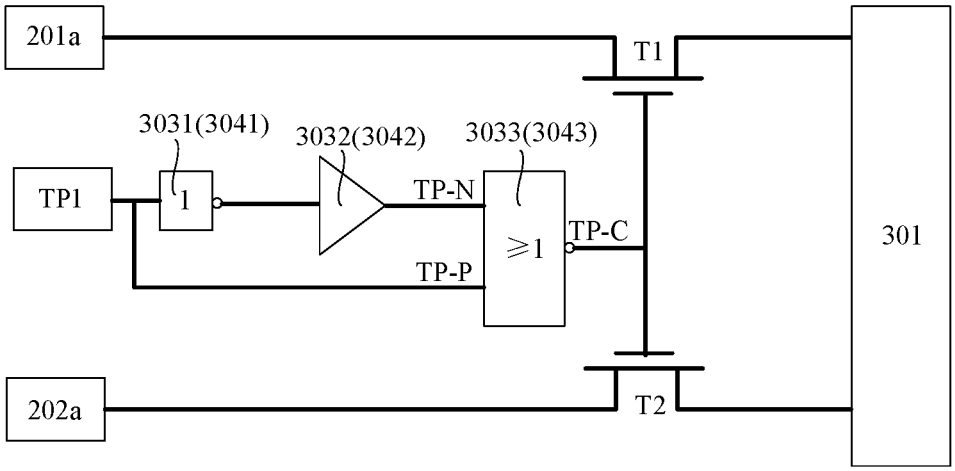

FIG. 4A to FIG. 4C are schematic structural diagrams of a voltage adjustment circuit provided by the present invention. The voltage comparison circuit is configured to determine whether a difference between absolute values of the first data voltage signal and the second data voltage signal at a preset moment exceeds a set threshold range, and output a control signal when the difference between the absolute values exceeds a threshold range, upon the plurality of sub-pixels in the two adjacent columns displaying a same gray scale. The voltage adjustment circuit is configured to adjust the first data latch and update signal TP1 of the first source driver chip based on the control signal, or adjust the second data latch and update signal TP2 of the second source driver chip, so that the first data voltage signal and the second data voltage signal are respectively output to the first data line DL1 and the second data line DL2 at a same time.

Optionally, the first initial moment t10 is the moment when the first data latch and update signal TP1 transitions from the second level to the first level, or the first initial moment t10 is the moment when the first data latch and update signal TP1 transitions from the first level to the second level. Optionally, the first initial moment t10 is the moment when the first data latch and update signal TP1*a* before adjustment transitions from the second level to the first level, or the first initial moment t10 is the moment when the first data latch and update signal TP1*a* before adjustment transitions from the first level to the second level.

Optionally, the second initial moment t20 is the moment when the second data latch and update signal TP2 transitions from the fourth level to the third level, or the second initial moment t20 is the moment when the second data latch and update signal TP2 transitions from the third level to the fourth level. Optionally, the second initial moment t20 is the moment when the second data latch and update signal TP2*a* before adjustment transitions from the fourth level to the third level, or the second initial moment t20 is the moment when the second data latch and update signal TP2*a* before adjustment transitions from the third level to the fourth level.

Optionally, since a time for holding the data latch and update signal generated by each source driver chip at a high level will not be easily changed due to factors such as register setting, the first data voltage signal and the second data voltage signal can be output to the first data line DL1 and the second data line DL2 respectively at the same time by adjusting the TP delay (TP delay includes TP1 delay and TP2 delay). That is, when the first initial moment t10 is the moment when the first data latch and update signal TP1 transitions from the first level to the second level, adjust the first initial moment t10 to adjust the moment when the first data latch and update signal TP1 transitions from the second level to the first level. Or when the second initial moment is the moment when the second data latch and update signal TP2 transitions from the third level to the fourth level, adjust the second initial moment t20 to adjust the moment when the second data latch and update signal TP2 transitions from the fourth level to the third level. Thus, the first data voltage signal and the second data voltage signal are respectively output to the first data line DL1 and the second data line DL2 at the same time, so as to reduce difficulty of adjustment and achieve the purpose of improving the problem of split screen.

Optionally, the preset moment is a moment when the first data latch and update signal transitions from the second level to the first level, or the second data latch and update signal transitions from the fourth level to the third level. Optionally, the preset moment is the moment when the first data latch and update signal TP1*a* before adjustment transitions from the second level to the first level, or the moment when the second data latch and update signal TP2*a* before adjustment transitions from the fourth level to the third level.

Optionally, in response to the difference between absolute values over the set threshold range, the voltage adjustment circuit 400 shifts the first initial moment t10 based on the unit time length, or the voltage adjustment circuit 400 shifts the second initial moment t20 based on the unit time length.

Optionally, the unit time length is a time length corresponding to the transmission of at least one data packet by the first source driver chip or the second source driver chip. Optionally, the time length corresponding to a packet can be 9UI, where UI=1/tr, tr represents a data transmission speed.

By setting the voltage comparison circuit 300 and the voltage adjustment circuit 400, the data voltage signal output by the corresponding source driver chip can be received at the same time when the two adjacent columns of sub-pixels are displayed with the same gray scale, and the two adjacent columns of sub-pixels are electrically connected with the first source driver chip 201 and the second source driver chip 202 respectively. Thus, the charge difference between the two adjacent columns of sub-pixels that are electrically connected to the first source driver chip 201 and the second source driver chip 202 respectively can be reduced, thereby improving the problem of split screen.

Optionally, the set threshold range is greater than or equal to 0 and less than or equal to the preset voltage. The inventor of the present application provides an empirical formula for setting the preset voltage after comprehensive experiments and experience and other factors. The preset voltage Vs is obtained by Vs=(K*Ta*Vgma1)/(Tth*255). K is an adjustment coefficient of a model. Ta is a time required for charging the sub-pixels in theory, and Tth is a time required for charging the sub-pixels in practice. Vgma1 is a data voltage corresponding to a brightness of 255 gray levels.

Both the first source driver chip 201 and the second source driver chip 202 have m output channels, the first source driver chip is configured to control the sub-pixels in a first column to an mth column, and the second source driver chip is configured to control the sub-pixels in an (m+1)th column to an 2mth column will be described as an example. And m is greater than or equal to 1.

When the voltage comparison circuit 300 and the voltage adjustment circuit 400 are not set, the first data voltage signal output by the first source driver chip 201 to the sub-pixels in the mth column and the second data voltage signal output by the second source driver chip 202 to the sub-pixels in the (m+1)th column are different due to the influence of signal transmission, processing technology, and load size. Therefore, even though the sub-pixels in the mth column and the sub-pixels in the (m+1)th column need to be configured to display the same gray scale based on the first data voltage signal and the second data voltage signal, the difference between the data voltage signals received by the sub-pixels of the mth column and the sub-pixels in the (m+1) column will cause different charging times of the sub-pixels in the mth column and the sub-pixels in the (m+1) column, thus causing the split screen problem.

After setting the voltage comparison circuit 300 and the voltage adjustment circuit 400, when the sub-pixels in the mth column and the sub-pixels in the (m+1) column need to be configured to display the same gray scale based on the first data voltage signal and the second data voltage signal, the moment when the first data voltage signal or the second data voltage signal is output can be adjusted by the voltage comparison circuit 300 and the voltage adjustment circuit 400. Thus, the moment of the data voltage signals received by the sub-pixels in the mth column and the sub-pixels in the (m+1) column are close, and the difference between the charging times between the sub-pixels in the mth column and the sub-pixels in the (m+1) column is reduced, so as to improve the problem of split screen.

Optionally, the driving control unit further includes a timing controller configured to output the data transmission start signal CS to the plurality of source driver chips.

Optionally, an adjustment range of the first initial moment t10 and the second initial moment t20 is from a beginning moment when the data transmission start signal CS becomes effective to a moment when the phase CN starts when the data line receives the data voltage signal (that is, as shown by Tb in FIG. 3).

Optionally, please continue to refer to FIG. 4A to FIG. 4C, the voltage comparison circuit 300 includes a subtractor 301 and a comparator 302.

A first input end of the subtractor 301 is configured to receive the first data voltage signal, A second input end of the subtractor 301 is configured to receive the second data voltage signal. the difference between the absolute values of the first data voltage signal and the second data voltage signal is calculated by the subtractor 301.

A first input end of the comparator 302 is electrically connected to an output end of the subtractor 301. A second input end of the comparator 302 is configured to receive a preset voltage. An output end of the comparator 302 is connected to the voltage adjustment circuit 400. the difference between the absolute values is compared with the preset voltage Vs by the comparator 302.

Optionally, the voltage comparison circuit 300 further comprises a first resistor R1. The first resistor R1 is connected in series between the second input end of the comparator 302 and the voltage adjustment circuit 400. The preset voltage Vs is applied to the second input end of the comparator 302 through the voltage adjustment circuit 400 and the first resistor R1.

Optionally, the voltage comparison circuit 300 further includes a first signal latch 303 and a second signal latch 304.

A first input end of the first signal latch 303 is configured to receive the first data voltage signal. A second input end of the first signal latch 303 is configured to receive the first data latch and update signal TP1 (as shown in FIG. 4A-FIG. 4C) or the second data latch and update signal TP2. An output end of the first signal latch 303 is electrically connected to the first input end of the subtractor. Optionally, the first input end of the first signal latch 303 is electrically connected to the first output buffer unit 201*a*.

A first input end of the second signal latch 304 is configured to receive the second data voltage signal. A second input end of the second signal latch 304 is configured to receive the first data latch and update signal TP1 (as shown in FIG. 4A-FIG. 4C) or the second data latch and update signal TP2. An output end of the second signal latch 304 is electrically connected to the second input end of the subtractor 301. Optionally, the first input end of the second signal latch 304 is electrically connected to the second output buffer unit 202*a*.

The second input end of the second signal latch 304 and the second input end of the first signal latch 303 are configured to receive a same signal to ensure that output of the first source driver chip 201 and the second source driver chip 202 can be triggered under a same trigger source, thus ensuring the effectiveness of the output comparison between the first source driver chip 201 and the second source driver chip 202.

Optionally, please continue to refer to FIG. 4B to FIG. 4C. The first signal latch 303 includes a first inverter 3031, a first buffer 3032, a first NOR gate 3033, and a first switch transistor T1. The second signal lock unit 304 includes a second inverter 3041, a second buffer 3042, a second or NOR gate 3043, and a second switch transistor T2.

An input end of the first switch transistor T1 is the first input end of the first signal latch 303. An input end of the first inverter 3031 is the second input end of the first signal latch 303. An output end of the first switching tube T1 is the output end of the first signal latch 303. An input end of the second switch transistor T2 is the first input end of the second signal latch 304. An input end of the second inverter 3041 is the second input end of the second signal latch 304. An output end of the second switching tube T2 is the output end of the second signal latch 304.

An output end of the first inverter 3031 is electrically connected to an input end of the first buffer 3032. An output end of the first buffer 3032 is electrically connected to a first input end of the first NOR gate 3033. A second input end of the first NOR gate 3033 is electrically connected to the input end of the first inverter 3031. An output end of the first NOR gate 3033 is electrically connected to a control end of the first switching tube T1.

An output end of the second inverter 3041 is electrically connected to an input end of the second buffer 3042. An output end of the second buffer 3042 is electrically connected to a first input end of the second NOR gate 3043. A second input end of the second NOR gate 3043 is electrically connected to the input end of the second inverter 3041. An output end of the second NOR gate 3043 is electrically connected to a control end of the second switching tube T2.

Figure 4D:
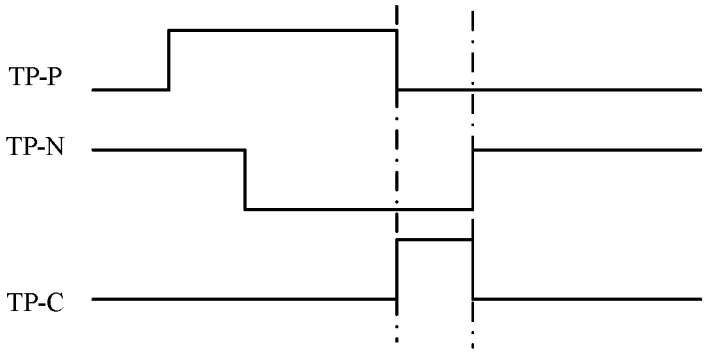
FIG. 4D is a timing diagram for controlling a first switch transistor provided by the present application.

Taking the second input of the first signal latch 303 configured to receive the first data latch and update signal TP1 as an example, an operating principle of the first signal latch 303 is described. After the first data latch and update signal TP1 is inverted and output by the first inverter 3031, it is buffered and delayed by the first buffer 3032 and transmitted to the first NOR gate 3033 with the first data latch and update signal TP1 not processed by the first inverter 3031 and the first buffer 3032. When the first data latch and update signal TP1 processed by the first inverter 3031 and the first buffer 3032 and the first data latch and update signal TP1 not processed by the first inverter 3031 and the first buffer 3032 are both at low level, the output of the first NOR gate 3033 is configured to control the conduction of the first switching tube T1 (as shown in FIG. 4D, which is a timing diagram for controlling a first switch transistor provided by the present application). Therefore, the second signal latch 304 and the first signal latch 303 are triggered to output data at a same time when the first data latch and update signal TP1 falls, so as to ensure that the adjustment result is more accurate and reliable.

It can be understood that an operating principle of the second signal latching unit 304 is the same as that of the first signal latching unit 303, and will not be repeated here.

Optionally, the second signal latch 304 and the first signal latch 303 share an inverter, a buffer, and a NOR gate, as shown in FIG. 4C, to reduce a number of components, thereby saving layout space and manufacturing cost.

Optionally, the subtractor 301 includes an operational amplifier, a second resistor R2, a third resistor R3, a fourth resistor R4, and a fifth resistor R5. The second resistor R2 is connected in series between the output end of the first signal latch 303 and an inverting input end of the operational amplifier. The third resistor R3 is connected in series between the output end of the second signal latch 304 and the non-inverting input end of the operational amplifier. The fourth resistor R4 is connected in series between an output end of the operational amplifier and the inverting input end of the operational amplifier. The fifth resistor R5 is electrically connected to the non-inverting input end of the operational amplifier. The output end of the operational amplifier is electrically connected to the output end of the subtractor 301. Optionally, R2=R3=R4=R5, so that an output voltage of the subtractor 301 is a difference between the first data voltage signal input by the first input end of the subtractor 301 and the second data voltage signal input by the second input end of the subtractor 301.

Optionally, the voltage adjustment circuit 400 includes a logic controller, a field programmable logic gate array, and the like.

It can be understood that because the display panel 100 is used with the plurality of source driver chips, there may be a plurality of split screen problems between two adjacent columns of sub-pixels that are electrically connected with different source driver chips in the display panel 100. Therefore, one or more voltage comparison circuits 300 and one or more voltage adjustment circuits 400 can be used for improvement.

Optionally, the voltage comparison circuit 300 and the voltage adjustment circuit 400 can be integrated into each source driver chip to continue to improve the problem of split screen after the display device leaves the factory. For example, when adjusting the first data latch and update signal TP1, the first source driver chip includes a voltage adjustment circuit 400 and a voltage comparison circuit 300.

Optionally, if the display device includes X source driver chips, X−1 voltage comparison circuits 300 and voltage adjustment circuits 400 can be configured to improve the plurality of screen split problems in the display panel.

Optionally, the voltage comparison circuit 300 and the voltage adjustment circuit 400 can also be set separately instead of being integrated in the source driver chip, so as to reduce the integration difficulty of the source driver chip.

Referring to FIG. 5A-FIG. 5D. FIG. 5A-FIG. 5D are flow charts of display methods provided by the embodiments of the present invention. The present invention also provides a display method used in any of the above display devices.

Figure 5A:
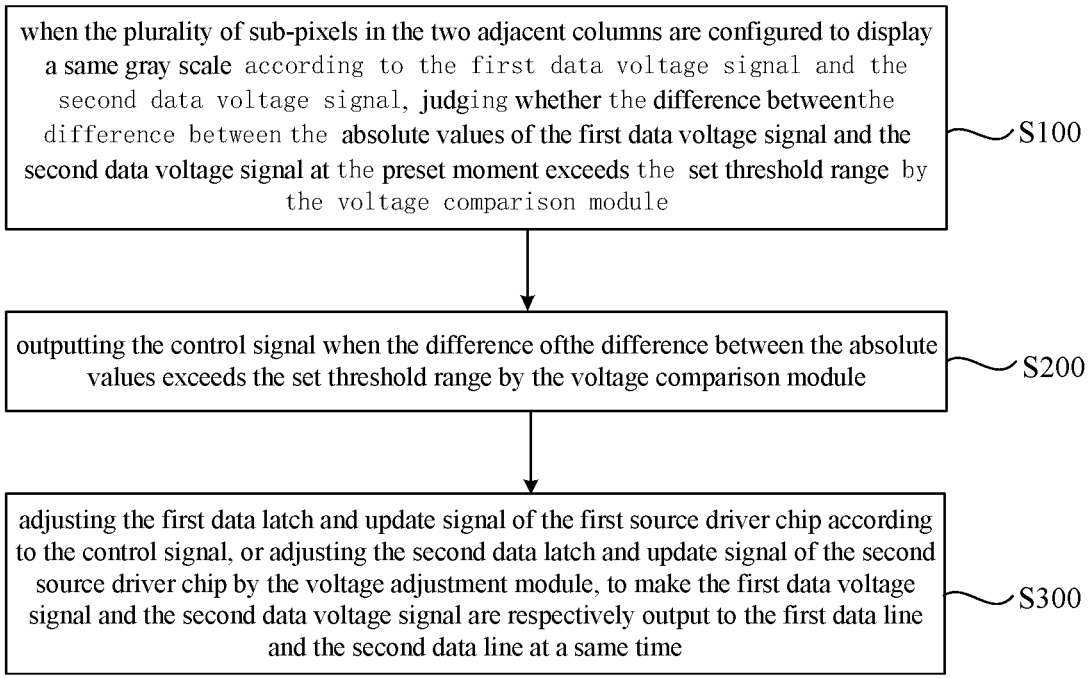
FIG. 5A-FIG. 5D are flow charts of display methods provided by the embodiments of the present invention.

Please continue to refer to FIG. 5A, the display methods include:

step S100: when the plurality of sub-pixels in the two adjacent columns are configured to display a same gray scale based on the first data voltage signal and the second data voltage signal, judging whether the difference between the absolute values of the first data voltage signal and the second data voltage signal at the preset moment exceeds the set threshold range by the voltage comparison circuit.

step S200: outputting the control signal in response to the difference between the absolute values over the set threshold range by the voltage comparison circuit.

step S300: adjusting the first data latch and update signal of the first source driver chip based on the control signal, or adjusting the second data latch and update signal of the second source driver chip by the voltage adjustment circuit, to make the first data voltage signal and the second data voltage signal are respectively output to the first data line and the second data line at a same time.

Figure 5B:
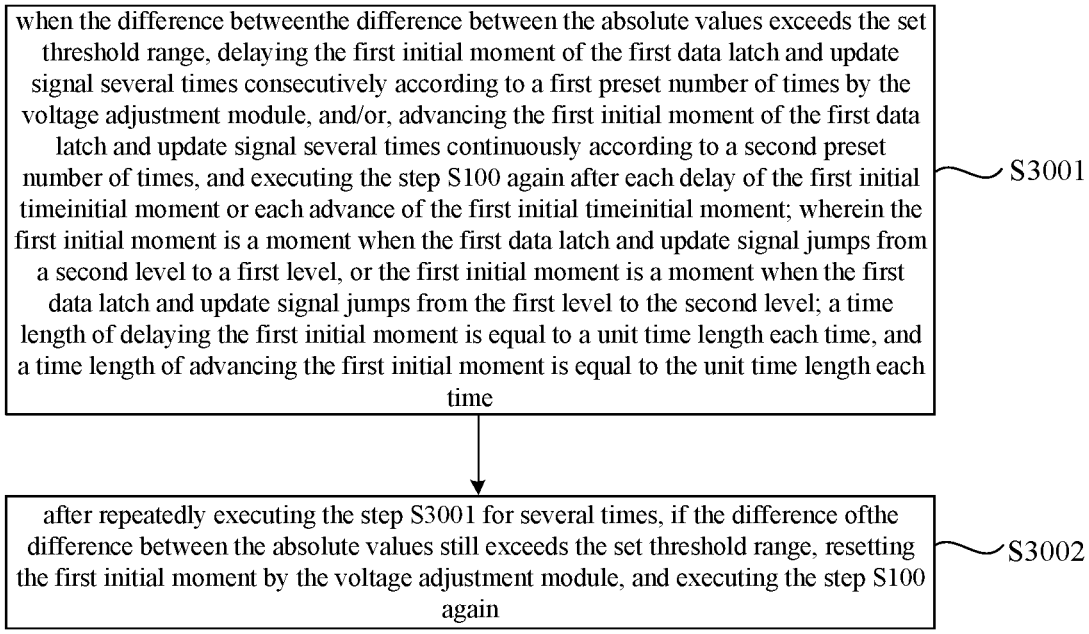

Optionally, step S300 includes:

step S3001: when the difference between the absolute values exceeds the set threshold range, delaying the first initial moment of the first data latch and update signal several times consecutively based on a first preset number of times by the voltage adjustment circuit, and/or, advancing the first initial moment of the first data latch and update signal several times continuously based on a second preset number of times, and executing the step S100 again after each delay of the first initial moment or each advance of the first initial moment; wherein the first initial moment is a moment when the first data latch and update signal transitions from a second level to a first level, or the first initial moment is a moment when the first data latch and update signal transitions from the first level to the second level; a time length of delaying the first initial moment is equal to a unit time length each time, and a time length of advancing the first initial moment is equal to the unit time length each time.

step S3002: after repeatedly executing the step S3001 for several times, if the difference between the absolute values still exceeds the set threshold range, resetting the first initial moment by the voltage adjustment circuit, and executing the step S100 again, as shown in FIG. 5B.

Figure 5C:
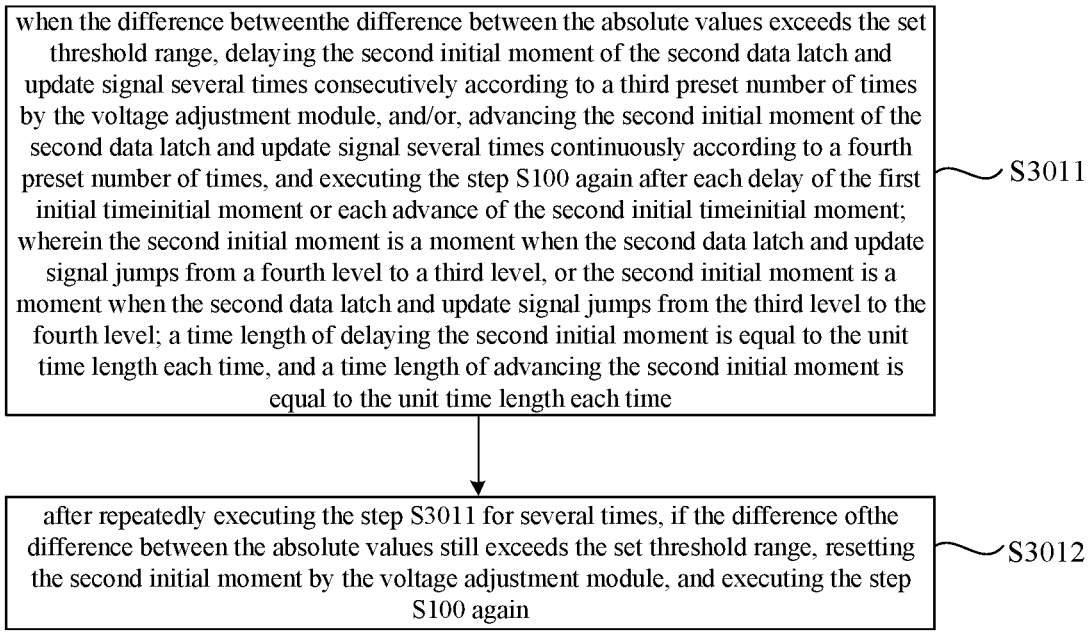

Optionally, the step S300 includes:

step S3011: when the difference between the absolute values exceeds the set threshold range, delaying the second initial moment of the second data latch and update signal several times consecutively based on a third preset number of times by the voltage adjustment circuit, and/or, advancing the second initial moment of the second data latch and update signal several times continuously based on a fourth preset number of times, and executing the step S100 again after each delay of the first initial moment or each advance of the second initial moment; wherein the second initial moment is a moment when the second data latch and update signal transitions from a fourth level to a third level, or the second initial moment is a moment when the second data latch and update signal transitions from the third level to the fourth level; a time length of delaying the second initial moment is equal to the unit time length each time, and a time length of advancing the second initial moment is equal to the unit time length each time;

step S3012: after repeatedly executing the step S3011 for several times, if the difference between the absolute values still exceeds the set threshold range, resetting the second initial moment by the voltage adjustment circuit, and executing the step S100 again, as shown in FIG. 5C.

Optionally, the first preset number of times is greater than or equal to 1. The second preset number of times is greater than or equal to 1. The third preset number of times is greater than or equal to 1. The fourth preset number of times is greater than or equal to 1.

It can be understood that the voltage adjustment circuit can perform a plurality of delay operations on the first initial moment of the first data latch and update signal, the voltage adjustment circuit can perform a plurality of advance operations on the first initial moment of the first data latch and update signal, and the delayed operations and the advanced operations are not prioritized, and the sequence can be adjusted based on actual needs. The voltage adjustment circuit can perform a plurality of delay operations on the second initial moment of the second data latch and update signal, the voltage adjustment circuit can perform a plurality of advance operations on the second initial moment of the second data latch and update signal, and the delayed operations and the advanced operations are not prioritized, and the sequence can be adjusted based on actual needs.

When the difference between the absolute values exceeds the set threshold range, the voltage adjustment circuit delays three times the first initial moment when the first data latch and update signal transitions from the second level to the first level (that is, the first preset number of times is equal to 3), then execute the voltage adjustment circuit to advance the first initial moment when the first data latch and update signal transitions from the second level to the first level three times (that is, the second preset number of times is equal to 3) as an example, the specific flow of the display method will be described.

Figure 5D:
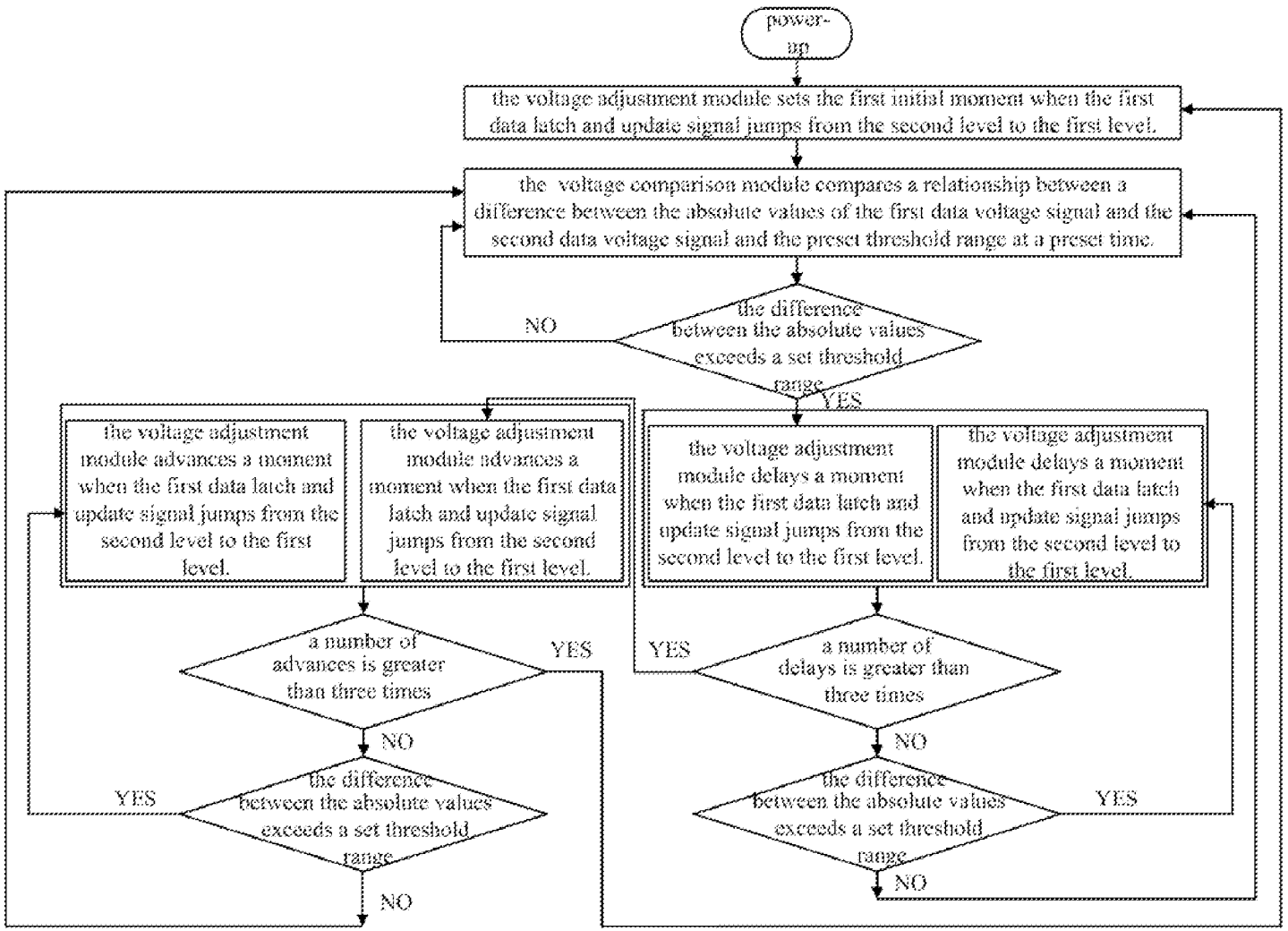

Please continue to refer to FIG. 5D. When the display device is power-up, the voltage adjustment circuit sets the first initial moment when the first data latch and update signal transitions from the second level to the first level. Afterwards, the voltage comparison circuit compares whether the difference between the absolute values of the first data voltage signal and the second data voltage signal at a preset time exceeds the set threshold range.

When the difference between the absolute values does not exceed the set threshold range, the voltage comparison circuit re-performs the comparison in next cycle.

When the difference between the absolute values exceeds the set threshold range, the voltage adjustment circuit delays the first initial moment when the first data latch and update signal transitions from the second level to the first level for a first time, and judges whether the number of delays is greater than three times. If the number of delays is not greater than three times, the voltage comparison circuit is configured to compare whether the difference between the absolute values of the first data voltage signal and the second data voltage signal at the preset time exceeds the set threshold range.

If the difference between the absolute values still exceeds the set threshold range, the voltage adjustment circuit delays the moment when the first data latch and update signal transitions from the second level to the first level for a second time on the basis of the first delay, and judges whether the number of delays is greater than three times. If the number of delays is not greater than three times, the voltage comparison circuit is configured to compare whether the difference between the absolute values of the first data voltage signal and the second data voltage signal at the preset time exceeds the set threshold range.

If the difference between the absolute values still exceeds the set threshold range, the voltage adjustment circuit delays the moment when the first data latch and update signal transitions from the second level to the first level for a third time on the basis of the second delay, and judges whether the number of delays is greater than three times. If the number of delays is not greater than three times, the voltage comparison circuit is configured to compare whether the difference between the absolute values of the first data voltage signal and the second data voltage signal at the preset time exceeds the set threshold range.

If the difference between the absolute values still exceeds the set threshold range, the voltage adjustment circuit delays the moment when the first data latch and update signal transitions from the second level to the first level for a fourth time on the basis of the third delay, and judges whether the number of delays is greater than three times. If the number of delays is greater than three times, the voltage adjustment circuit advances the moment when the first data latch and update signal transitions from the second level to the first level for a first time, and judges whether a number of adcances is greater than three times. If the number of advances is not more than three times, the voltage adjustment circuit is configured to compare whether the difference between the absolute values of the first data voltage signal and the second data voltage signal at the preset time exceeds the set threshold range.

If the difference between the absolute values still exceeds the set threshold range, the voltage adjustment circuit advances the moment when the first data latch and update signal transitions from the second level to the first level for a second time on the basis of the first delay, and judges whether the number of advances is greater than three times. If the number of advances is not greater than three times, the voltage adjustment circuit is configured to compare whether the difference between the absolute values of the first data voltage signal and the second data voltage signal at the preset time exceeds the set threshold range.

If the difference between the absolute values still exceeds the set threshold range, the voltage adjustment circuit advances the moment when the first data latch and update signal transitions from the second level to the first level for a third time on the basis of the second delay, and judges whether the number of advances is greater than three times. If the number of advances is not greater than three times, the voltage adjustment circuit is configured to compare whether the difference between the absolute values of the first data voltage signal and the second data voltage signal at the preset time exceeds the set threshold range.

If the difference between the absolute values still exceeds the set threshold range, the voltage adjustment circuit advances the moment when the first data latch and update signal transitions from the second level to the first level for a fourth time on the basis of the third delay, and judges whether the number of advances is greater than three times. If the number of advances is greater than three times, after resetting the first initial moment when the first data latch and update signal transitions from the second level to the first level, step S100 is executed again.

The present invention also provides a display device, including a display panel, a first source driver chip, a second source driver chip, a voltage comparison circuit, and a voltage adjustment circuit.

Understandably, the display devices include movable display devices (such as laptop computers, mobile phones, etc.), fixed terminals (such as desktop computers, TVs (such as 8K120, 8K240 and other ultra-high-definition, high-refresh-rate products), etc., measurement devices (such as sports bracelets, thermometers, etc.), etc.

In this paper, specific examples have been used to illustrate the principles and implementation methods of the present invention, and the description of the embodiments is merely intended to help understand the method and core ideas of the present application. At the same time, for those skilled in the art, based on the idea of the present application, there will be changes in the specific implementation and application scope. From the above discussion, the contents of this manual should not be understood as limitations on present application.

What is claimed is:

1. A display device, comprising:

a display panel, comprising a plurality of sub-pixels and a plurality of data lines that comprise a first data line and a second data line electrically connected to the plurality of sub-pixels in two adjacent columns respectively;

a first source driver chip, configured to output a first data voltage signal to the first data line at a first moment;

a second source driver chip, configured to output a second data voltage signal to the second data line at a second moment;

a voltage comparison circuit, configured to output a control signal in response to a difference between the absolute values of the first data voltage signal and the second data voltage signal over a threshold range at a preset moment, upon the plurality of sub-pixels in the two adjacent columns displaying a same gray scale; and a voltage adjustment circuit, configured to adjust a first data latch and update signal of the first source driver chip based on the control signal, or adjust a second data latch and update signal of the second source driver chip, so that the first data voltage signal and the second data voltage signal are respectively output to the first data line and the second data line at a same time.

2. The display device according to claim 1, wherein the voltage adjustment circuit is configured to adjust a first initial moment of the first data latch and update signal based on the control signal, or adjust a second initial moment of the second data latch and update signal, to output the first data voltage signal and the second data voltage signal to the first data line and the second data line at a same time, where the first initial moment is a moment when the first data latch and update signal transitions from a second level to a first level, or the first initial moment is a moment when the first data latch and update signal from the first level to the second level; the second initial moment is a moment when the second data latch and update signal transitions from a fourth level to a third level, or the second initial moment is a moment when the second data latch and update signal transitions from the third level to the fourth level, wherein the preset moment is the moment when the first data latch and update signal transitions from the second level to the first level, or the second data latch and update signal transitions from the fourth level to the third level.

3. The display device according to claim 2, wherein the voltage comparison circuit comprises:

a subtractor, wherein a first input end of the subtractor is configured to receive the first data voltage signal, and a second input end of the subtractor is configured to receive the second data voltage signal; and a comparator, wherein a first input end of the comparator is electrically connected to an output end of the subtractor, a second input end of the comparator is configured to receive a preset voltage, and an output end of the comparator is connected to the voltage adjustment circuit.

4. The display device according to claim 3, wherein the voltage comparison circuit further comprises a first resistor connected between the second input end of the comparator and the voltage adjustment circuit.

5. The display device according to claim 3, wherein the voltage comparison circuit further comprises:

a first signal latch, wherein a first input end of the first signal latch is configured to receive the first data voltage signal, a second input end of the first signal latch is configured to receive the first data latch and update signal or the second data latch and update signal, and an output end of the first signal latch is electrically connected to the first input end of the subtractor;

a second signal latch, wherein a first input end of the second signal latch is configured to receive the second data voltage signal, a second input end of the second signal latch is configured to receive the first data latch and update signal or the second data latch and update signal, and an output end of the second signal latch is electrically connected to the second input end of the subtractor, wherein the second input end of the second signal latch and the second input end of the first signal latch are configured to receive the same signal.

6. The display device according to claim 5, wherein the first signal latch comprises a first inverter, a first buffer, a first NOR gate, and a first switch transistor;

an input end of the first switch transistor is the first input end of the first signal latch, an input end of the first inverter is the second input end of the first signal latch, an output end of the first switching tube is the output end of the first signal latch; an output end of the first inverter is electrically connected to an input end of the first buffer, an output end of the first buffer is electrically connected to a first input end of the first NOR gate, a second input end of the first NOR gate is electrically connected to the input end of the first inverter, an output end of the first NOR gate is electrically connected to a control end of the first switching tube; and the second signal latch comprises a second inverter, a second buffer, a second NOR gate, and a second switching tube; an input end of the second switch transistor is the first input end of the second signal latch, an input end of the second inverter is the second input end of the second signal latch, an output end of the second switching tube is the output end of the second signal latch; an output end of the second inverter is electrically connected to an input end of the second buffer, an output end of the second buffer is electrically connected to a first input end of the second NOR gate, a second input end of the second NOR gate is electrically connected to the input end of the second inverter, an output end of the second NOR gate is electrically connected to a control end of the second switching tube.

7. The display device according to claim 5, wherein the second signal latch and the first signal latch share an inverter, a buffer, and a NOR gate.

8. The display device according to claim 3, wherein the preset voltage Vs is obtained by Vs=(K*Ta*Vgma1)/(Tth*255);

where K is an adjustment coefficient of a model, Ta is a time required for charging the sub-pixels in theory, and Tth is a time required for charging the sub-pixels in practice, Vgma1 is a data voltage corresponding to a brightness of 255 gray level.

9. The display device according to claim 8, wherein the threshold range ranges between 0 and to the preset voltage.

10. The display device according to claim 2, wherein the first data latch and update signal is a signal generated inside the first source driver chip, and the second data latch and update signal is a signal generated inside the second source driver chip.

11. The display device according to claim 2, further comprising a timing controller, configured to output a data transmission start signal to the first source driver chip and the second source driver chip, wherein an adjustment range of the first initial moment ranges from a beginning moment when the data transmission start signal becomes effective to a start moment when the first data line receives the first data voltage signal; an adjustment range of the second initial moment ranges from a beginning moment when the data transmission start signal becomes effective to a start moment when the second data line receives the second data voltage signal.

12. The display device according to claim 1, wherein in response to the difference between absolute values over the set threshold range, the voltage adjustment circuit shifts the first initial moment based on a unit time length, or the voltage adjustment circuit shifts the second initial moment based on the unit time length.

13. The display device according to claim 12, wherein the unit time length is a time length corresponding to the transmission of at least one data packet by the first source driver chip or the second source driver chip.

14. The display device according to claim 1, wherein both the first source driver chip and the second source driver chip are integrated with the voltage comparison circuit and the voltage adjustment circuit.

15. A display method used in a display device, the display device comprising:

a display panel, comprising a plurality of sub-pixels and a plurality of data lines that comprise a first data line and a second data line electrically connected to the plurality of sub-pixels in two adjacent columns respectively;

a first source driver chip, configured to output a first data voltage signal to the first data line at a first moment;

a second source driver chip, configured to output a second data voltage signal to the second data line at a second moment;

a voltage comparison circuit, configured to output a control signal in response to a difference between the absolute values of the first data voltage signal and the second data voltage signal over a threshold range at a preset moment, upon the plurality of sub-pixels in the two adjacent columns displaying a same gray scale; and a voltage adjustment circuit, configured to adjust a first data latch and update signal of the first source driver chip based on the control signal, or adjust a second data latch and update signal of the second source driver chip, so that the first data voltage signal and the second data voltage signal are respectively output to the first data line and the second data line at a same time;

the display method comprising:

step S100: when the plurality of sub-pixels in the two adjacent columns are configured to display a same gray scale based on the first data voltage signal and the second data voltage signal, judging whether the difference between the absolute values of the first data voltage signal and the second data voltage signal at the preset moment exceeds the set threshold range by the voltage comparison circuit;

step S200: outputting the control signal in response to the difference between the absolute values over the set threshold range by the voltage comparison circuit;

step S300: adjusting the first data latch and update signal of the first source driver chip based on the control signal, or adjusting the second data latch and update signal of the second source driver chip by the voltage adjustment circuit, to make the first data voltage signal and the second data voltage signal are respectively output to the first data line and the second data line at a same time.

16. The display method according to claim 15, wherein the step S300 comprises:

step S3001: when the difference between the absolute values exceeds the set threshold range, delaying the first initial moment of the first data latch and update signal several times consecutively based on a first preset number of times by the voltage adjustment circuit, and/or, advancing the first initial moment of the first data latch and update signal several times continuously based on a second preset number of times, and executing the step S100 again after each delay of the first initial moment or each advance of the first initial moment; wherein the first initial moment is a moment when the first data latch and update signal transitions from a second level to a first level, or the first initial moment is a moment when the first data latch and update signal transitions from the first level to the second level; a time length of delaying the first initial moment is equal to a unit time length each time, and a time length of advancing the first initial moment is equal to the unit time length each time, step S3002: after repeatedly executing the step S3001 for several times, if the difference between the absolute values still exceeds the set threshold range, resetting the first initial moment by the voltage adjustment circuit, and executing the step S100 again;

or, the step S300 comprises:

Step S3011: when the difference between the absolute values exceeds the set threshold range, delaying the second initial moment of the second data latch and update signal several times consecutively based on a third preset number of times by the voltage adjustment circuit, and/or, advancing the second initial moment of the second data latch and update signal several times continuously based on a fourth preset number of times, and executing the step S100 again after each delay of the first initial moment or each advance of the second initial moment; wherein the second initial moment is a moment when the second data latch and update signal transitions from a fourth level to a third level, or the second initial moment is a moment when the second data latch and update signal transitions from the third level to the fourth level; a time length of delaying the second initial moment is equal to the unit time length each time, and a time length of advancing the second initial moment is equal to the unit time length each time;

Step S3012: after repeatedly executing the step S3011 for several times, if the difference between the absolute values still exceeds the set threshold range, resetting the second initial moment by the voltage adjustment circuit, and executing the step S100 again.

* * * * *